United States Patent [19]

Rasmussen

[11] 4,299,042

[45] Nov. 10, 1981

[54] FRAME CONSTRUCTION FOR A PROJECTING ILLUMINATED SIGN BOX

[75] Inventor: Paul Rasmussen, Varde, Denmark

[73] Assignee: Colorlux a-s, Esbjerg, Denmark

[21] Appl. No.: 105,763

[22] Filed: Dec. 19, 1979

[30] Foreign Application Priority Data

Dec. 27, 1978 [DK] Denmark ..... 5831/78

[51] Int. Cl.[3] ..... G09F 13/04

[52] U.S. Cl. ..... 40/571; 40/572; 40/575; 40/578

[58] Field of Search ..... 40/571, 572, 575, 576, 40/578, 549, 154, 155, 606, 610

[56] References Cited

U.S. PATENT DOCUMENTS

| | | | |
|---|---|---|---|
| 871,510 | 11/1907 | Kerr | 40/575 |
| 3,235,989 | 2/1966 | Brooks | 40/549 |
| 3,390,259 | 6/1968 | Angier | 40/549 |
| 3,396,483 | 8/1968 | Stein et al. | 40/549 |
| 3,835,613 | 9/1974 | Davies, Jr. | 40/549 X |
| 3,863,372 | 2/1975 | Stilling | 40/549 X |

*Primary Examiner*—Robert Peshock
*Assistant Examiner*—G. Lee Skillington
*Attorney, Agent, or Firm*—Haseltine and Lake

[57] ABSTRACT

A frame construction for an illuminated sign comprises a metal sheathing on both top and bottom frame members of the frame, the sheathing being bent at its longitudinal edges to form longitudinally extending grooves, wherein both the top and the bottom frame members having longitudinally extending flanges inserted in the sheathing, while the longitudinal grooves of the sheathing are employed for mounting partly translucent front sheets, end frame members of the frame including tongues extending perpendicular thereto which are insertable into cavities formed by the longitudinal bent portions of the sheathing.

1 Claim, 4 Drawing Figures

FRAME CONSTRUCTION FOR A PROJECTING ILLUMINATED SIGN BOX

FIELD OF THE INVENTION

The invention relates to a frame construction for an illuminated sign box comprising a metal sheathing on the top and bottom frame members, in which both the top and the bottom frame members formed from bent metal sheet.

PRIOR ART CONSTRUCTIONS

An illuminated sign box is known from U.S. Pat. No. 1,226,357.

Furthermore, U.S. Pat. No. 2,083,258 discloses a frame construction of the above type which requires a large number of transverse metal stays. However, the illuminated sign box of this prior patent is relatively troublesome to assemble. Furthermore, the insensitiveness to side winds is rather doubtful.

OBJECT OF THE INVENTION

The object of the invention is to provide a frame construction which is easy to assemble and which nevertheless provides a very rigid illuminated sign box, which furthermore may be made completely rainproof.

INVENTIVE CONCEPT

The frame construction according to the invention is characterized by the sheathing being bent at the longitudinal edges thereof to form longitudinal grooves. Longitudinally extending flanges of top and bottom frame members are inserted in the bent portions of the sheathing, while the longitudinal grooves of the sheathing are used for mounting partly translucent front sheets.

According to the invention it is preferred that end frame members of the frame comprise projecting tongues formed so as to be insertable in cavities formed by the longitudinal bent portions of the sheathing.

Finally, according to the invention, internal, diagonal stays with adjustment possibilities are provided, whereby outer stays are avoided and at the same time the replacement of the light means is facilitated.

DESCRIPTION OF THE DRAWINGS

The invention will be described below with reference to the accompanying drawing, in which.

Figure 1:
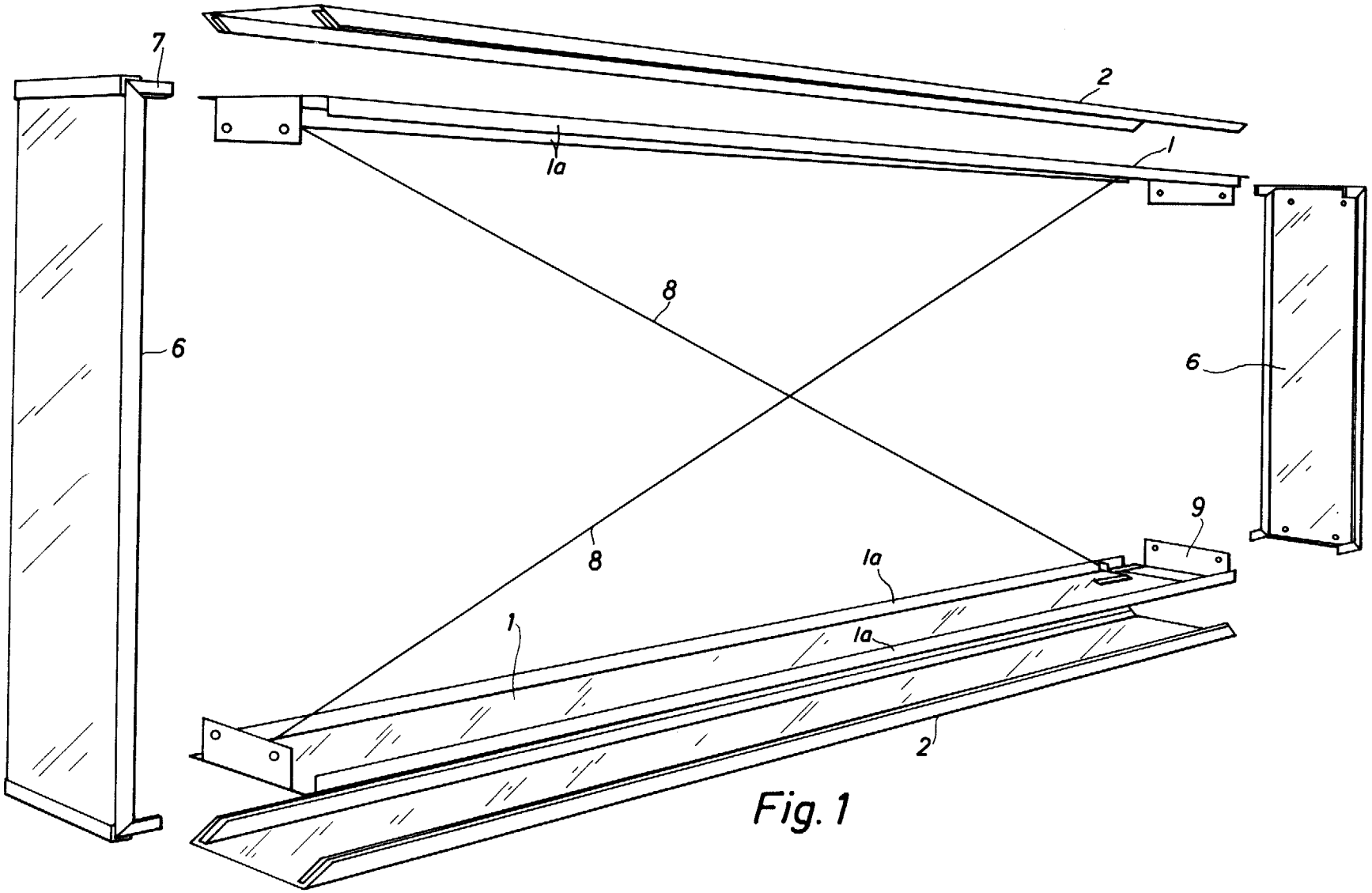
FIG. 1 illustrates a frame construction according to the invention for a projecting illuminated sign box.

The frame construction illustrated in FIG. 1 for a projecting illuminated sign box comprises a top planar frame member and a bottom planar frame member, the bottom frame member being identical with the top frame member, each being a bent metal sheet 1 having longitudinally extending flanges 1*a* which respectively extend downwardly and upwardly of the top and bottom frame members. The frame members each are inserted in a metal sheathing 2, the flanges 1*a* of the frame members being inserted into bent portions of the sheathing 2, of FIG. 2.

The sheathing 2 preferably is made of aluminum and is bent to form longitudinal channels 3, said grooves being used for mounting front and rear panels 4.

Figure 2:
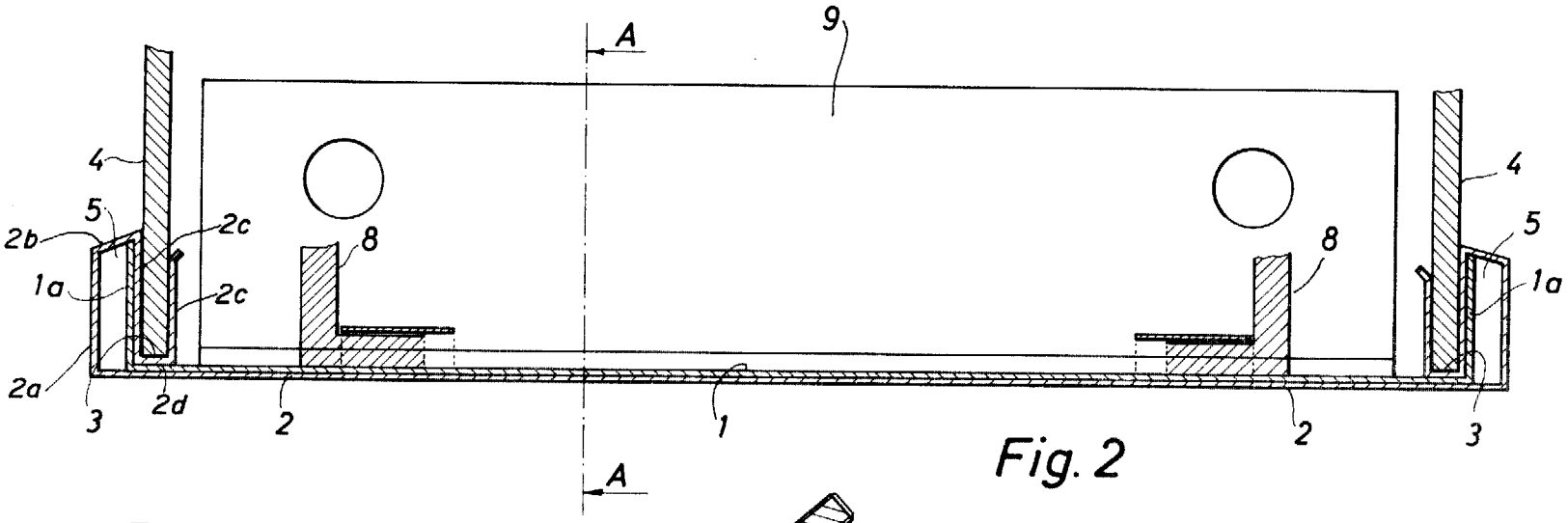
FIG. 2 illustrates the under side of the illuminated sign box.

As is shown more clearly in FIG. 2, the sheathing of metal sheeting on the outwardly presented faces of said top and bottom frame members includes first longitudinally extending flange portions 2*a* which extend substantially parallel to the outwardly presented faces of said frame member flanges 1*a* and in spaced relationship thereto, second longitudinally extending flange portions 2*b* integral with said first flange portions 2*a* and which extend across the longitudinal edges of said frame member flanges 1*a*, third longitudinally extending flange portions 2*c* integral with said second longitudinally extending flange portions 2*b* and which extend parallel to and in face contact with inwardly presented faces of said frame member flanges 1*a*, fourth longitudinally extending flange portions 2*d* integral with said third longitudinally extending flange portions 2*c* and which extend parallel to and in face contact with inwardly presented faces of said top and bottom frame members 1, and fifth longitudinally extending flange portions 2*e* integral with said fourth longitudinally extending flange portions 2*d* and which extend in parallel spaced relationship with said third longitudinally extending flange portions 2*e* and which define channels 3 for the reception and support of front and rear panels 4 of said sign box.

The cavities 5 resulting from the bending of the sheathing 2 furthermore provide flange portions with a predetermined moment of resistance. Seen from the exterior, the bent portions of the sheathing, i.e. the profilings, assume the form of solid or firm strips for a frame.

Both at the top and at the bottom of end frame members 6 are provided V-shaped tongues 7, the tongues 7 projecting perpendicularly to the gables, cf. FIG. 1. The width and the height of these projecting tongues correspond exactly to the width and the height of the remaining portion of a cavity 5 after the insertion of one of the flanges 1*a* of the frame members 1 into the cavity 5". By inserting the projecting tongues 7 into these cavities, a simple and nevertheless rainproof assembling is obtained, avoiding the requirement for additional securing members.

Figure 4:
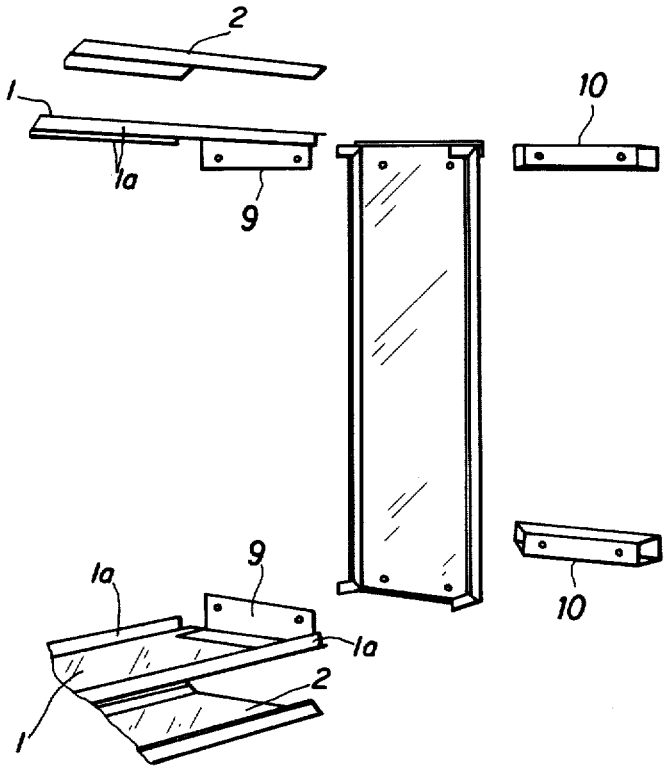
FIG. 4 illustrates the securing of the illuminated sign box to a wall surface by means of bases.

On one of the gables 6, mounting members 10 are secured, cf. FIG. 4, which are used for securing the sign box to a wall surface by means of end flanges 9 secured to the frame members 1.

Figure 3:
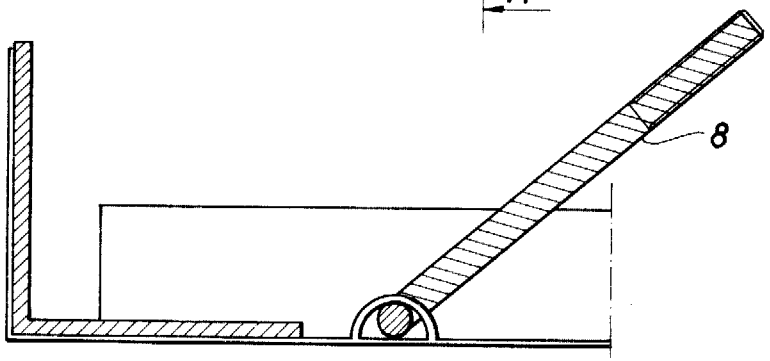
FIG. 3 is a sectional view along the line A—A of the under side illustrated in FIG. 2.

Diagonal stays or bars 8 are provided in the interior of the illuminated sign box. These stays or bars are preferably adjustable in length. The stays or the bars ensure that the illuminated sign box does not fall in. Furthermore, they facilitate the replacement of the individual light means. FIGS. 2 and 3 illustrate the pivotable securing of the stays to the bottom frame member.

The rigid frame members 1 make the illuminated sign box relatively insensitive to side winds.

According to the invention it is thus possible by means of the particular shape of the sheathing to provide an illuminated sign box which is easy to assemble and which nevertheless is rainproof and sufficiently rigid.

The gables may optionally be determined by angle brackets both at the top and at the bottom.

The frame construction and the illuminated sign box according to the invention may be varied in many ways without deviating from the scope of the invention as defined in the appended claims.

I claim:

1. In a frame construction for an illuminated sign box of the type having a top planar frame member having downwardly extending longitudinal flanges, a bottom planar frame member having upwardly extending longitudinal flanges, and end frame members detachably secured to end flanges of said top and bottom frame members to provide a substantially rigid rectangular frame, the improvement comprising:

a sheathing of metal sheeting on the outwardly presented faces of said top and bottom frame members, said sheathing having first longitudinally extending flange portions which extend substantially parallel to outwardly presented faces of said frame member flanges and in spaced relationship thereto, second longitudinally extending flange portions integral with said first flange portions and which extend across the longitudinal edges of said frame member flanges, third longitudinally extending flange portions integral with said second longitudinally extending flange portions and which extend parallel to and in face contact with inwardly presented faces of said frame member flanges, fourth longitudinally extending flange portions integral with said third longitudinally extending flange portions and which extend parallel to and in face contact with inwardly presented faces of said top and bottom frame members, and fifth longitudinally extending flange portions integral with said fourth longitudinally extending flange portions and which extend in parallel spaced relationship with said third longitudinally extending flange portions and which define channels for the reception and support of front and rear panels of said sign box.

* * * * *